United States Patent [19]

Fukuda

[11] Patent Number: 4,637,491

[45] Date of Patent: Jan. 20, 1987

[54] MUFFLER FOR INTERNAL COMBUSTION ENGINE AND METHOD OF MANUFACTURING TUBES FOR USE THEREIN

[75] Inventor: Masuo Fukuda, Omiya, Japan

[73] Assignee: Sankei Giken Kogyo Kabushiki Kaisha, Tokyo, Japan

[21] Appl. No.: 746,260

[22] Filed: Jun. 19, 1985

[30] Foreign Application Priority Data

Jun. 21, 1984 [JP] Japan ..... 59-127766

[51] Int. Cl.[4] ..... F01N 1/08

[52] U.S. Cl. ..... 181/265; 181/256; 181/266; 181/272

[58] Field of Search ..... 181/256, 265, 266, 272

[56] References Cited

U.S. PATENT DOCUMENTS

| | | | |
|---|---|---|---|
| 3,141,518 | 7/1964 | Heath | 181/266 |
| 3,181,647 | 5/1965 | Schomburg | 181/266 |
| 3,370,674 | 2/1968 | Jettinghoff | 181/265 |
| 4,164,266 | 8/1979 | Collin et al. | 181/266 X |

*Primary Examiner*—Benjamin R. Fuller

*Attorney, Agent, or Firm*—Birch, Stewart, Kolasch & Birch

[57] ABSTRACT

A muffler for use on an internal combustion engine includes an enclosure generally cylindrical and having end plates for closing the internal volume of the enclosure, at least one partition plate for dividing the internal volume of the enclosure into at least two chambers, an inlet tube, supported by one of said end plates and at least one partition plate, for conducting combustion gases supplied from the engine to one of the chambers; an outlet tube, supported by the other of the end plates and at least one partition plate, for blowing out the gases from remaining one of the chambers; and a connecting tube supported by said at least one partition plate for interconnecting the volume of adjacent ones of the chambers. At least two of the inlet, outlet and connecting tubes are integrally made of a single sheet of metal shaped to form a combination tube including the at least two tubes. A method of manufacturing such a combination tube is also provided.

9 Claims, 12 Drawing Figures

MUFFLER FOR INTERNAL COMBUSTION ENGINE AND METHOD OF MANUFACTURING TUBES FOR USE THEREIN

BACKGROUND OF THE INVENTION

1. Field of the Invention

The present invention relates to a muffler for an internal combustion engine for use in a motor vehicle, for example, and a method of manufacturing tubes for use in such a muffler.

2. Description of the Prior Art

In general, mufflers, or silencers, of the type to which the invention is directed include a plurality of expansion or resonance chambers into which a muffler body is divided by partitions and which are arranged in its longitudinal direction. The interiors of the chambers are interconnected by associated connecting tubes to conduct combustion gasses, supplied through an inlet tube from a internal combustion engine connected, to the series of the chambers in a predetermined order. The gases blow out of the final chamber into the air via an outlet pipe.

Conventionally, inlet, inteconnecting and outlet tubes for use in mufflers of the type described above were made in separate units so as to be combined by end plates and partitions which the tubes are inserted through and supported by. The tubes are generally welded to the end plates and partitions.

In general, improvement of the performance in attenuating noise due to exhaustion of combustion gases gives rise to increasing the volume of mufflers and complicating the internal structural configuration thereof. Specifically, the conventional technique for obtaining performance improvement of mufflers inherently requires an increase in kind and number of constituent elements, such as partitions and connecting tubes, involved in a muffler, as well as an increase in welding portions for affixing those elements with each other.

In the prior art, higher performance mafflers are, therefore, heavier in weight and more massive, and require much more time and cost in manufacturing.

SUMMARY OF THE INVENTION

It is therefore an object of the present invention to provide a muffler for an internal combustion engine which is simplied in structure and manufacturable by simplifed manufacturing steps.

In accordance with the present invention, there is provided a muffler of the type which includes a plurality of expansion or resonance chambers into which a muffler body is divided by partitons and which are arranged in its longitudinal direction, the volume of the chambers being interconnected by associated interconnecting tubes to conduct combustion gasses, supplied through an inlet tube from an internal combustion engine connected, to the series of the chambers in a predetermined order, the gases blowing out of the final one of the chambers via an outlet pipe, at least some of the interconnecting, inlet and outlet tubes being made integrally of a single sheet of metal so as to form an assembly integrally including those tubes.

In accordance with the invention, a muffler for use in an internal combustion engine comprises: an enclosure generally cylindrical and having end plates for closing the internal volume of said enclosure; at least one partition plate for dividing the internal volume of said enclosure into at least two chambers; an inlet tube supported by one of said end plates and at least one partition plate for conducting combustion gases supplied from the engine to one of the chambers; an outlet tube supported by the other of said end plates and at least one partition plate for blowing out the gases from remaining one of the chambers; and a connecting tube supported by said at least one partition plate for interconnecting the volume of adjacent ones of the chambers; at least two of said inlet, outlet and connecting tubes being integrally made of a single sheet of metal shaped to form a combination tube including said at least two tubes.

The present invention also provides a method of manufacturing an integral combination tube for use in a muffler comprising the steps of: preparing a flat sheet of metal; shaping said sheet so as to include common and end subsections conforming tubes which are to be combined with said muffler in the form of the combination tube; bending said subsections round in the opposite directions perpendicular to the longitudinal axes of said tubes with respect to the common subsection to form the side walls of said tubes; and removing a portion other than corresponding to said tubes.

In an aspect of the invention, a method of manufacturing an integral combination tube for use in a muffler comprises the steps of: preparing a tube of which the cross section is divided by at least one dividing wall into a plurality of sectors corresponding in number to the tubes which are to be combined with said muffler in the form of the combination tube; forming notches at the positions corresponding to the longitudinal ends of said tubes; and removing a portion other than corresponding to said tubes.

BRIEF DESCRIPTION OF THE DRAWINGS

The objects and features of the present invention will become more apparent from the consideration of the following detailed description taken in conjunction with the accompanying drawings in which.

DESCRIPTION OF THE PREFERRED EMBODIMENTS

Figure 1:
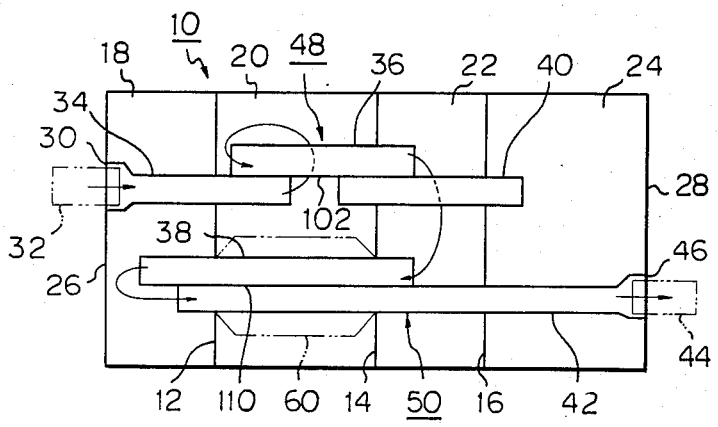
FIG. 1 is a schematic plan view showing a central, longitudinal cross section of an embodiment of a muffler having a resonance chamber in accordance with the present invention.

With reference to FIG. 1, a muffler with a resonance chamber for use in an internal combustion engine includes a muffler body 10, which is generally cylindrical to form an outer enclosure or casing. Body 10 is divided by partitions or lateral plates 12, 14 and 16 into four sections to form expansion chambers 18, 20 and 22, and a resonance chamber 24 in the order from left to right in the figure. Expansion chambers 18, 20 and 22 are adapted to expand the combustion gases conducted thereto, and resonance chamber 24 is adapted to resonate the gases conducted thereto.

Muffler body 10 has end plates 26 and 28, one of which 26 has a generally circular opening 30, which may receive an exhaust pipe or tube 32, which is connected to an internal combustion engine associated to exhaust combustion gases from the engine. Connected to opening 30 is an inlet pipe 34, which extends in the longitudinal direction of body 10 to have a sufficient length for conducting combustion gases supplied from exhaust pipe 30 to expansion chamber 20, and is welded to be supported by partition 12. Chamber 20 is called a first expansion chamber.

Partition plate 14 has an interconnecting pipe or tube 36 welded to be supported thereby. Tube 36 connects the inside volume of chambers 20 and 22, the latter of which is referred to as a second expansion chamber. A certain length of one end portion of tube 36 protrudes into the inside of the chamber 22.

Chamber 20 communicates with resonance chamber 24 by a throat tube 40, which is welded to be supported by partitions 14 and 16 beyond chamber 22. Certain lengths of the opposite end portions of tube 40 protrude into the inside of the chambers 20 and 24. In the embodiment, throat or connecting pipe 40 may advantageously be arranged coaxially with inlet tube 34.

In the embodiment, pipes 34, 36 and 40 may advantageously be made of a single sheet of metal cut to form an integral combination 48 of tubes, which generally extends in the longitudinal direction of body 10.

Partition 14 has also another interconnecting tube 38 welded to be supported thereby together with partition 12. Tube 38 connects the inside volume of chambers 22 and 18. Chamber 18 forms a third, or final, expansion chamber.

Final chamber 18 has an outlet tube 42, which is welded to be supported by partitions 12, 14 and 16 beyond chamber 20, 22 and 24 to communicate with the outside, i.e. a drain pipe which is connectable to a generally cylindrical opening 46 formed in the other end plate 28. A certain length of the end portion of tube 42 protrudes into the inside volume of chamber 18.

In the embodiment also, pipes 38 and 42 may advantageously be made of a single sheet of metal cut to form an integral combination 50 of tubes, which generally extends in the longitudinal direction of body 10.

Combination tubes 48 and 50 may advantageously be manufactured each from a single sheet of metal by any conventional machining technique.

Figure 2:
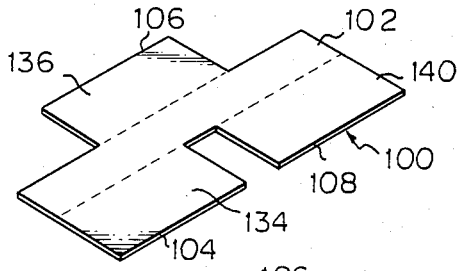
FIGS. 2, 3 and 4 are the perspective views useful for understanding steps of manufacturing combined tubes for use in the muffler shown in FIG. 1.

With respect to combination tube 48, for example, a sheet of metal or blank 100 is prepared which is cut into the shape which has a main portion 102 and subsections 134, 136 and 140. Subsections 134, 136 and 140 correspond in size and position to the portions of side walls which will, after manufactured, form partially pipes 34, 36 and 40, respectively. As seen in FIG. 2, subsections 134 and 140 extend from one side of main portion 102, and subsection 136 extends from the other side of main portion 102.

Figure 3:
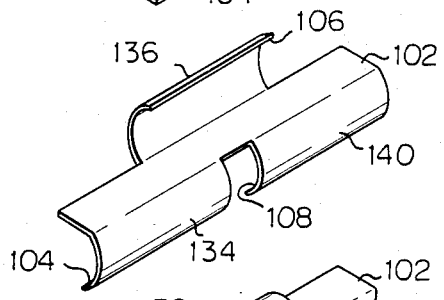
Figure 4:
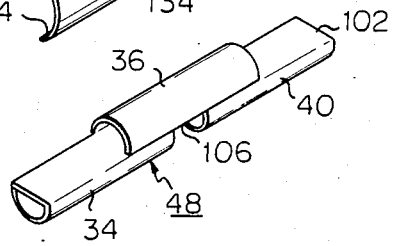

With respect to the primary plane of main portion 102, subsection 136 is then bent or curved round in one direction, while subsections 134 and 140 are curved in the other direction, as shown in FIG. 3. As seen from FIG. 3, the lateral cross section of the curved structure is generally of an S shape. After completion of the shaping processes, combined tube 48 is obtained which includes inlet tube 34, and interconnection tubes 36 and 40. Those tubes 34, 36 and 40 have a common flat portion 102, and are generally of a crescent or half circle shape. Side ends 104, 106 and 108 of subsections 134, 136 and 140, respectively, may advantageously be affixed to the associated edge portions of common, flat plate 102 by welding, for example.

Combination tube 50 may also be manufactured by appropriate steps similar to those described with respect to manufacturing combination tube 48. Combination tubes 48 and 50, thus prepared, will in turn be combined with maffler body 10 by welding, for example, to be secured to end plates 26 and 28, and partitions 12, 14 and 16.

Figure 9:
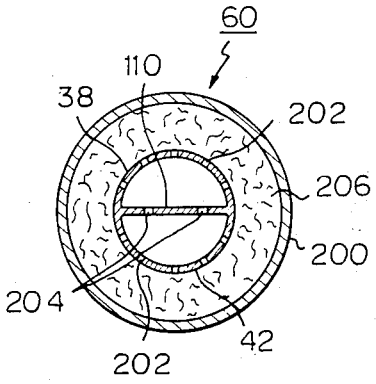
FIG. 9 shows an expanded, lateral cross section of a higher frequency noise attenuator unit included in the illustrative embodiments.

Combined tube 50 may be provided with a higher frequency attenuator unit 60 as depicted by the phantom lines in FIG. 1. Attenuator 60 includes, as clearly shown in FIG. 9, comprises an enclosure or casing 200, which is generally cylindrical to extend in the longitudinal direction of muffler body 10, and has a diameter longer than that of combination tube 48. The longitudinal length of unit 60 is preferably less than that of first expansion chamber 20 so as to be encapsulated therewithin.

The side walls of pipes 38 and 42 may advantageously have a plurality of small openings 202 cut so as to communicate the inside to the outside of tubes 38 and 42. The cylindrical space formed between the outer walls of pipes 38 and 40 and the casing 200 includes a buffering material 206 which is adapted to effectively absorb the noise coming through openings 202 from the inside of tubes 38 and 42. The total structure of unit 60 will advantageously cancel or attenuate the noise which is higher in frequency.

Common plate 110, which separates tubes 38 and 42, may have a plurality of small openings 204, causing the sound to interfere with each other between both of tubes 38 and 42.

Figure 5:
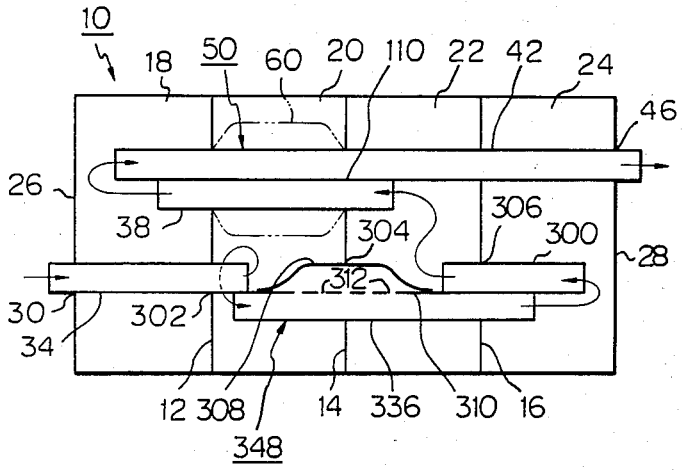
FIG. 5 is a schematic plan view which is similar to FIG. 1 and shows another embodiment of a muffler in accordance with the present invention.

With reference to FIG. 5, which shows alternative embodiment of the invention, the like elements are designated by the same reference numerals as in FIG. 1, and redundant descriptions will be omitted. Different from the FIG. 1 embodiment, in the alternative embodiment, chamber 24 functions as an additional expansion chamber rather than the resonance chamber as in the embodiment shown in FIG. 1.

For the purpose of this functioning of chamber 24, the muffler shown in FIG. 5 includes a combination tube 348 which is slightly different in structure from that of combination tube 48, FIG. 1. Combination tube 348 is composed of inlet pipe 34, interconnecting pipes 336 and 300.

Interconnecting tube 336 connects the inside volume of expansion chamber 20 with that of additional expansion chamber 24. Also interconnecting tube 300 couples the inside volume of expansion chamber 24 to that of expansion chamber 22. In this embodiment, interconnecting pipe 300 may advantageously be arranged coaxially with inlet tube 34. Combination tube 348 is secured by partitions 12, 14 and 16 by means of an appropriate connecting method, such as welding.

Pursuant to that structure, chambers 20, 24, 22 and 18 functions as the first, second, third and final expansion chambers, respectively.

Before closing the muffler body with end plates 26 and 28, combination tube 348 is inserted through generally circular openings 302, 304 and 306 formed in partitions 12, 14 and 16, respectively. Thereafter, tubes 34, 336 and 300 will be affixed to respective plates 12, 14 and 16. As seen from FIG. 5, opening 304 is substantially same in diameter as opening 306, which is larger than opening 302 in the present instance. In order to fill the space which would otherwise occur between the periphery of opening 304 and the outer wall of tube 336, a filler portion 308 may advantageously be provided, which forms a tube with the opposite ends closed, as shown in the figure. Filler tube 308 may preferably be of the same shape as, and in coaxial with, tube 34 or 300.

Those tubes 34, 336, 300 and 308 have a common, flat portion 310 to form portions of the side walls thereof. In the embodiment shown in FIG. a portion of common plate 310 forming part of filler tube 308 has advantageously a plurality of openings 312 so that the inside space of filler pipe 308 functions as a resonator for the noise transmitted through tube 336.

Combination tube 50 includes tubes 38 and 42 formed integrally from a single sheet of metal, and may advantageously be provided with attenuator unit 60, as dipicted by the phantom lines in FIG. 5. Alos, combination tube 348 includes tubes 34, 336, 308 and 300 formed integrally from a single sheet of metal.

Figure 6:
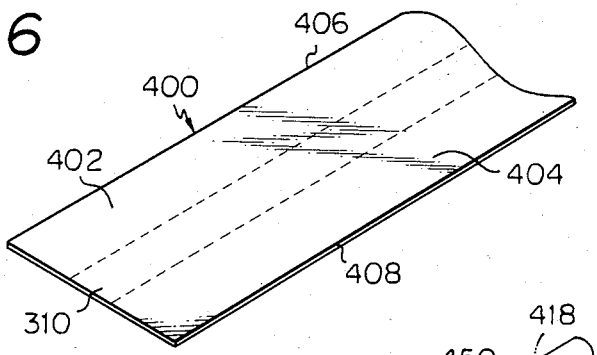
FIGS. 6, 7 and 8 are the perspective views useful for understanding steps of manufacturing combined tubes employed in the muffler shown in FIG. 5.
Figure 7:
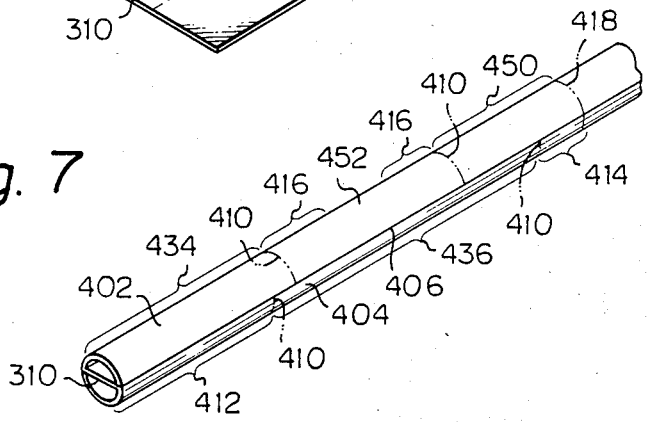

With respect to combination tube 348, a sheet of metal, such as a sheet material for hoop 400, is prepared. As shown in FIG. 6, the middle strip portion of sheet 400 will form common plate 310 when completed into combination tube 348 through the manufacturing processes. The opposite side portions 402 and 404 of sheet 400 with respect to middle portion 310 are then bent or curved round in the directions opposite to each other, as shown in FIG. 7. As seen from the figure, the lateral cross section of the curved structure is generally of an S shape.

After completion of the shaping processes, side edges 406 and 408 of side portions 402 and 404, respectively, may advantageously be affixed to the associated edge portions of common, flat plate 310 by welding, for example.

The cylindrically shaped, resultant structure is then cut of phantom line 418 into the separate length thereof substantially equal to the longitudinal length of combination tube 348. Then, lateral notches 410 are cut at the appropriate positions partially into the cylindrical structure almost by the depth of the cross sectional crescent of the cylindrical structure, that is, until notches 410 almost reach common plate 310 from the associated opposite sides with respect thereto. The positions of notches 410 are so selected that resultant portions 434, 450, 436 and 452 correspond to tubes 34, 336, 300 and 308, respectively.

Figure 8:
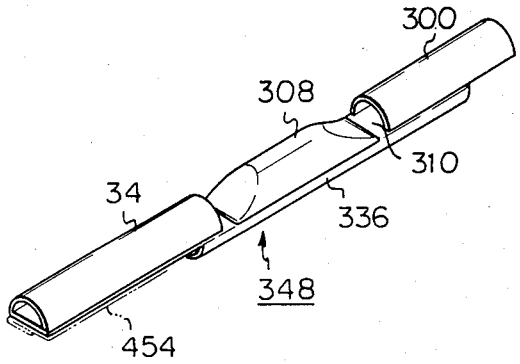

The remaining portions 412 and 414 may be cut out or folded as exemplarily shown in FIG. 8 by phantom line 454. Similarly, the opposite end portions 416, which are to form the corresponding parts of filler tube or attenuator unit 308, may be crashed or folded as shown in FIG. 8.

Combined tube 348 is obtained which includes inlet tube 34, throat tubes 336 and 300, and filler tube 308. Those tubes 34, 336, 300 and 308 have a common flat portion 310, and are generally of a crescent or half circle shape. The tubes forming combination tubes 48, 50 and 348, for exapmle, may be selectable in size with respect to adjacent two of those tubes when shaped from a sheet material desribed above.

Figure 10:
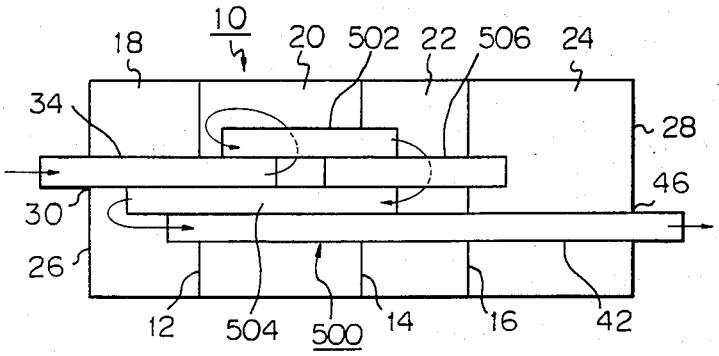
FIG. 10 is a schematic plan view which shows, similar to FIG. 1, another embodiment of a muffler in accordance with the present invention.

With reference to FIG. 10, in which like components are designated by the same reference numerals, another alternative embodiment of the invention includes a single combination tube 500, which comprises inlet tube 34, interconnecting tubes 502 and 504, and throat tube 506. In the FIG. 10 embodiment, chamber 24 functions as a resonance chamber.

Interconnection tube or pipe 502 interconnects expansion chambers 20 and 22, while interconnection tube 504 interconnects expansion chambers 22 and 18. Throat pipe 506 interconnects expansion chambers 22 with resonance chamber 24. Throat pipe 506 is arranged in coaxial with inlet tube 34 in the embodiment. Combination tube assembly 500 may advantageously be formed integrally from a single sheet of metal, in the embodiment, by appropriate shaping and welding techniques.

Figure 11:
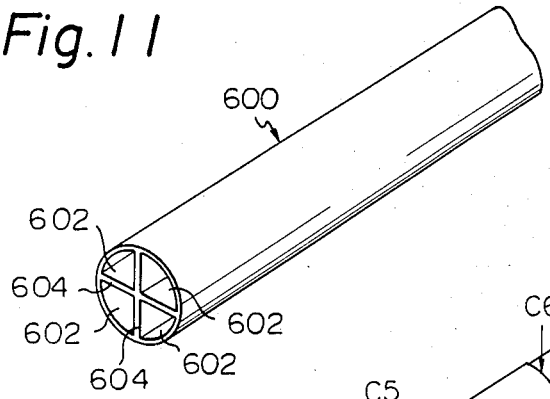
FIGS. 11 and 12 are the perspective views useful for understanding steps of manufacturing combined tubes included in the muffler shown in FIG. 10.

For example, there is prepared by extrusion a tube 600 of which the cross section is divided into four quadrants 602, which are separated by dividing walls 604, as shown in FIG. 11. Tube 600 is then cut into the length which is appropriate or substantially equal to the entire, longitudinal length of combination tube 500. It is to be noted that tube 600, from which combination tube 500 is shaped, is cylindrical in the embodiment, and that any tube having other cross sectional shape, such as square or rectangle, may also applicable to manufacturing combined tube 500 if it has such a different shape. The number of divided sectors 602, i.e. quadrants in this instance, is defined by the number of tubes which are to be included in combination tube 500.

Figure 12:
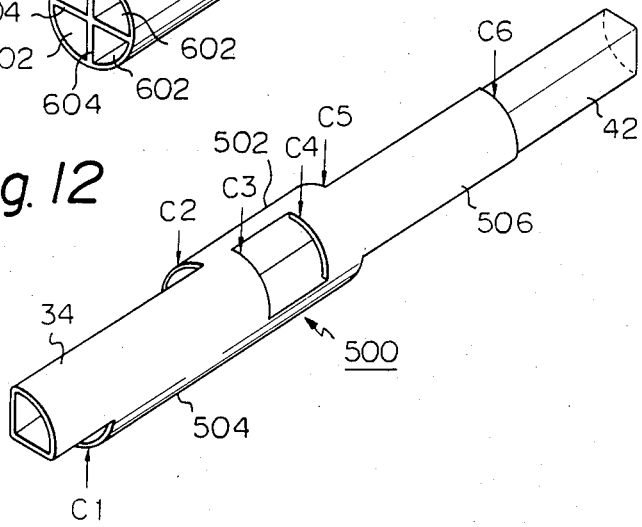

Thereafter, notches are made in the side wall of tube 600 at the positions indicated by C1 through C6 shown in FIG. 12. The positions C1 through C6 are so selected as to define the lengths of respective tubes 34, 502, 504, 506 and 42. More specifically, the position C3 defines the longitudinal length of pipe 34. The positions C1 and C5 define the longitudinal length of pipe 504. The positions C2 and C5 define the longitudinal length of pipe 502. The positions C4 and C6 define the longitudinal length of pipe 506. The longitudinal length of outlet tube 42 is defined by a cutting position, not shown in FIG. 12, which position is located between the positions C1 and C2.

The appropriate subsections corresponding to tubes 34, 502, 504, 506 and 42 will then be formed by removing or crushing the remaining or undesired portions thereof so as to complete the combined tube 500 shown in FIG. 12.

Partitions 12, 14 and 16 have the openings having the shapes corresponding to the cross sections of appropriate one of tubes 34, 502, 504, 506 and 42 which is received thereby. End plates 26 and 28 have a generally circular openings 30 and 46, respectively. In order to comform the shape of openings 30 and 46, therefore, the end portions of inlet and outlet tubes 34 and 42 are then shaped so round as to have a generally circular, lateral cross section. This will facilitate inlet and outlet tubes 34 and 42 to be suitably coupled with external pipes of the associated engine system.

In accordance with the present invention, mufflers of the expansion type include a combination tube which is composed of adjacent tubes formed integrally from a single sheet material, such as of metal. This structure facilitates mufflers to be assembled by a fewer number of assembling steps. More specifically, during manufacturing processes, it is easy to position the tubes or pipes appropriately, and welding portions are reduced in number between the tubes and the partitions associated. Additionally, constituent elements required for composing mufflers will be reduced in number, resulting in reduction in size and weight of mufflers with improved performances for silencer.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A muffler for use in an internal combustion engine comprising:

an enclosure generally cylindrical and having end plates for closing the internal volume of said enclosure;

at least one partition plate for dividing the internal volume of said enclosure into at least two chambers;

an inlet tube, supported by both one of said end plates and at least one partition plate, for conducting combustion gases supplied from the engine to one of said chambers;

an outlet tube, supported by both the other of said end plates and at least one partition plate, for blowing out the gases from remaining one of said chambers; and a connecting tube supported by said at least one partition plate for interconnecting the volume of adjacent ones of said chambers;

at least two of said inlet, outlet and connecting tubes being integrally made of a single sheet of metal shaped to form a combination tube including said at least two tubes.

2. A muffler in accordance with claim 1, wherein said inlet and connecting tubes are integrally made of a single sheet of metal shaped to form a combination tube including said two tubes.

3. A muffler in accordance with claim 1, wherein said outlet and connecting tubes are integrally made of a single sheet of metal shaped to form a combination tube including said two tubes.

4. A muffler in accordance with claim 1, wherein said inlet, outlet and connecting tubes are integrally made of a single sheet of metal shaped to form a combination tube including said tubes.

5. A muffler in accordance with claim 1, further comprising means provided on said combination tube for attenuating higher frequency noise transmitted through at least one of the tubes which are included in said combination tube.

6. A muffler in accordance with claim 1, further comprising filler means provided on said combination tube for filling a space which would otherwise be formed between said combination tube and at least one partition plate supporting said combination tube.

7. A muffler in accordance with claim 6, wherein said filler means forms a resonance chamber communicating the volume of at least one of the tubes which are included in said combination tube.

8. A muffler in accordance with claim 1, wherein said chambers include an expansion chamber for expanding the gases conducted thereto.

9. A muffler in accordance with claim 1, wherein said chambers include a resonance chamber for resonating the gases conducted thereto.

* * * * *